US012656091B2

(12) United States Patent
Gershonsky et al.

(10) Patent No.: US 12,656,091 B2
(45) Date of Patent: Jun. 16, 2026

(54) POLYMERIC-BASED AMMUNITION CARTRIDGE CASING WITH IMPROVED GEOMETRY

(71) Applicant: IMI SYSTEMS LTD., Ramat Hasharon (IL)

(72) Inventors: Ariel Gershonsky, Ramat Hasharon (IL); Jacob Kobi Swissa, Ramat Hasharon (IL); Boris Murarash, Ramat Hasharon (IL)

(73) Assignee: IMI SYSTEMS LTD., Ramat Hasharon (IL)

( * ) Notice: Subject to any disclaimer, the term of this patent is extended or adjusted under 35 U.S.C. 154(b) by 95 days.

(21) Appl. No.: 18/783,434

(22) Filed: Jul. 25, 2024

(65) Prior Publication Data

US 2026/0063399 A1 Mar. 5, 2026

Related U.S. Application Data

(63) Continuation of application No. PCT/IL2023/050080, filed on Jan. 24, 2023.

(30) Foreign Application Priority Data

Jan. 25, 2022 (IL) ..... 290208

(51) Int. Cl.
*F42B 5/307* (2006.01)

(52) U.S. Cl.
CPC ..... *F42B 5/307* (2013.01)

(58) Field of Classification Search
CPC ..... F42B 5/307
See application file for complete search history.

(56) References Cited

U.S. PATENT DOCUMENTS 3,745,924 A * 7/1973 Scanlon ..... F42B 5/307 102/467
3,874,294 A 4/1975 Hale
2007/0261587 A1 11/2007 Chung
(Continued)

FOREIGN PATENT DOCUMENTS

| | | |
|---|---|---|
| CA | 2570743 | 6/2008 |
| EP | 2872851 | 5/2015 |
| FR | 861071 | 1/1941 |

*Primary Examiner* — Reginald S Tillman, Jr.
(74) *Attorney, Agent, or Firm* — PEARL COHEN ZEDEK LATZER BARATZ LLP

(57) ABSTRACT

A polymer-based ammunition cartridge casing including a casing body having proximal and distal end and a longitudinal cylindrical wall extending between the proximal and the distal ends and enveloping a hollow interior of the casing body, wherein the longitudinal cylindrical wall of the casing body includes: a first longitudinal wall portion including the proximal end of the casing body and shaped to connect to a casing base, and further shaped such that when the casing base is connected, at least most of an outer surface of the casing base remains exposed; a second longitudinal wall portion connected at its proximal end to a distal end of the first longitudinal wall portion, wherein a minimal inner diameter of the first longitudinal wall portion is smaller than an inner diameter of the proximal end of the second longitudinal wall portion. The cartridge casing may include more than two longitudinal wall portions.

7 Claims, 7 Drawing Sheets

(56) References Cited

U.S. PATENT DOCUMENTS

| | | | |
|---|---|---|---|
| 2008/0202372 | A1 | 8/2008 | Mittelstaedt |
| 2012/0111219 | A1 | 5/2012 | Burrow |
| 2014/0076188 | A1 | 3/2014 | Maljkovic et al. |
| 2018/0292186 | A1 | 10/2018 | Padgett et al. |
| 2018/0306558 | A1 | 10/2018 | Padgett et al. |
| 2021/0041211 | A1 | 2/2021 | Pennell et al. |
| 2021/0055088 | A1 | 2/2021 | Peterson et al. |
| 2021/0254951 | A1 | 8/2021 | Padgett et al. |

* cited by examiner

| | D1:D2 > 0.97 | D1:D2 < 0.97 |
|---|---|---|
| Percentage of unintended mechanical failures of polymeric/composite ammunition cartridge casing after firing tests | 20% | 0% |
| Representative images of polymeric/composite ammunition cartridge casings after firing tests |  |  |

| Polymer Type | VST [ºC] | HDT [ºC] ISO 75 (1.8Mpa) | Unintended mechanical failure (Yes/No) | Representative images |
|---|---|---|---|---|
| Polymer 1 | <120 | <90 | Yes |  |
| Polymer 2 | <120 | <90 | Yes |  |
| Polymer 3 | >120 | >90 | No |  |
| Polymer 4 | >120 | >90 | No |  |

POLYMERIC-BASED AMMUNITION CARTRIDGE CASING WITH IMPROVED GEOMETRY

CROSS REFERENCE TO RELATED APPLICATIONS

This application is a Continuation of International Application No. PCT/IL2023/050080, filed Jan. 24, 2023, which claims priority from Israel Patent Application No. 290208, filed Jan. 25, 2022, both of which are incorporated herewith by reference in their entirety.

FIELD OF THE INVENTION

The present invention relates to the field of ammunition cartridge casings, and more particularly, to ammunition cartridge casings based on polymeric materials.

BACKGROUND OF THE INVENTION

A typical ammunition article includes four basic components as follows: a bullet, a cartridge casing holding the bullet, a propellant used to push the bullet down the barrel, and a primer used to ignite the propellant.

The cartridge casing is configured to contain the propellant media as well as the primer. Traditionally, cartridge casings have been manufactured from brass or other metals. More recently, cartridge casings are being manufactured, at least partially, from polymeric materials or composite materials.

The use of polymeric materials for cartridge casings poses many design challenges due to various limitations of polymeric materials and strength requirements associated with ammunition articles. Some polymer-based cartridge casings are multi-piece and include a casing body made of polymeric material and a case base which is typically made of metal and includes the primer. These multi piece casings tend to suffer from various structural failures during a firing event.

SUMMARY OF THE INVENTION

Some embodiments of the present invention provide a polymer-based ammunition cartridge casing which addresses the challenges of using polymeric material for ammunition cartridge casing by suggesting an improved geometry which includes variable thickness of the walls is some parts along the longitudinal cylindrical wall of the casing body.

The polymer-based ammunition cartridge casing includes a casing body having a proximal end, a distal end and a longitudinal cylindrical wall extending between the proximal end and the distal end and enveloping a hollow interior of the casing body.

The ammunition cartridge casing body may be made of a polymeric material or may be made of a composite material including a polymeric material. The casing body of polymer-based ammunition cartridge casing, according to some embodiments of the present invention may be referred to herein as "casing body".

The longitudinal cylindrical wall of the casing body includes: a first longitudinal wall portion comprising the proximal end of the casing body and shaped to connect a to a casing base comprising a primer; and a second longitudinal wall portion connected at its proximal end to a distal end of the first longitudinal wall portion;

According to some embodiments of the present invention, a minimal inner diameter of the first longitudinal wall portion is smaller than an inner diameter of the proximal end of the second longitudinal wall portion.

According to some embodiments, the casing body further includes a third longitudinal wall portion connected at its proximal end to a distal end of the second longitudinal section and tapering in a direction extending from the proximal end towards a distal end of the third longitudinal section; and a fourth longitudinal wall portion connected at its proximal end to the distal end of the third longitudinal section and comprising the distal end of the casing body.

According to some embodiments, the first longitudinal wall portion may be shaped to connect to a casing base, and further shaped such that when the casing base is connected, at least most of an outer surface of the casing base remains exposed.

According to some embodiments, longitudinal cylindrical wall of casing body may include: (i) a first longitudinal wall portion having a proximal end −1 coinciding with proximal end of casing body and configured to connect a casing base with a primer (not shown); (ii) a second longitudinal wall portion connected at its proximal end to a distal end of first longitudinal wall portion; (iii) a third longitudinal wall portion connected at its proximal end to a distal end of second longitudinal section and tapering in a direction extending from its proximal end towards its distal end; and (iv) a fourth longitudinal wall portion connected at its proximal end to the distal end of third longitudinal section and having a distal end coinciding with distal end of casing body. First longitudinal wall portion, second longitudinal wall portion, third longitudinal wall portion and fourth longitudinal wall portion may be formed as integral portions of longitudinal cylindrical wall of casing body.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same can be carried into effect, reference will now be made, purely by way of example, to the accompanying drawings in which like numerals designate corresponding elements or sections throughout.

In the accompanying drawings.

Figures 1, 1A:
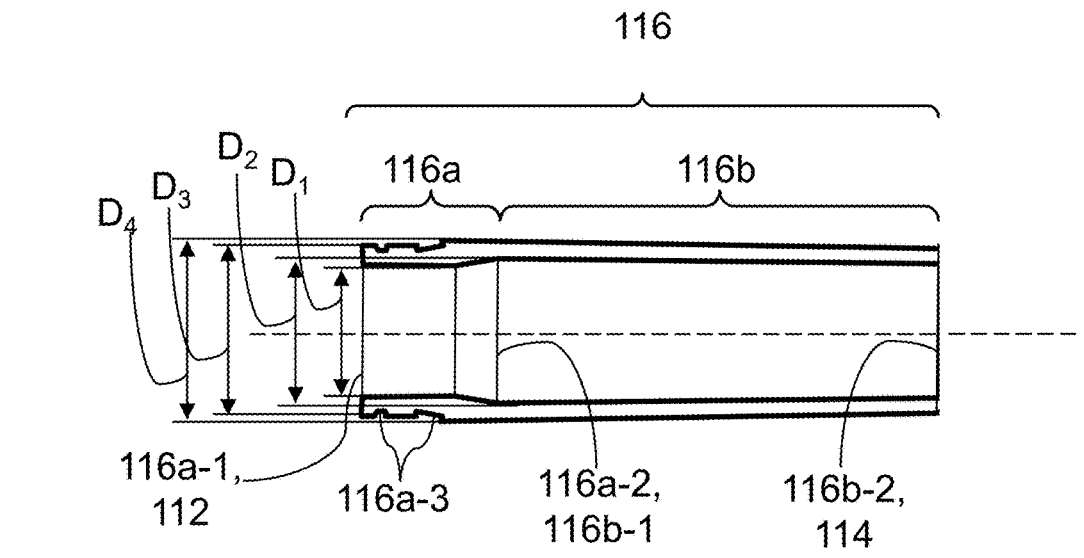
FIGS. 1A-1 and FIG. 1A-2 are schematic illustrations of a casing body having a thickened first longitudinal wall portion, according to some embodiments of the invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following description, various aspects of the present invention are described. For purposes of explanation, specific configurations and details are set forth in order to provide a thorough understanding of the present invention. However, it will also be apparent to one skilled in the art that the present invention can be practiced without the specific details presented herein. Furthermore, well known features can have been omitted or simplified in order not to obscure the present invention. With specific reference to the drawings, it is stressed that the particulars shown are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention can be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments that can be practiced or carried out in various ways as well as to combinations of the disclosed embodiments. Also, it is to be understood that the phraseology and terminology employed herein is for the purpose of description and should not be regarded as limiting.

Figures 1, 1A, 2:
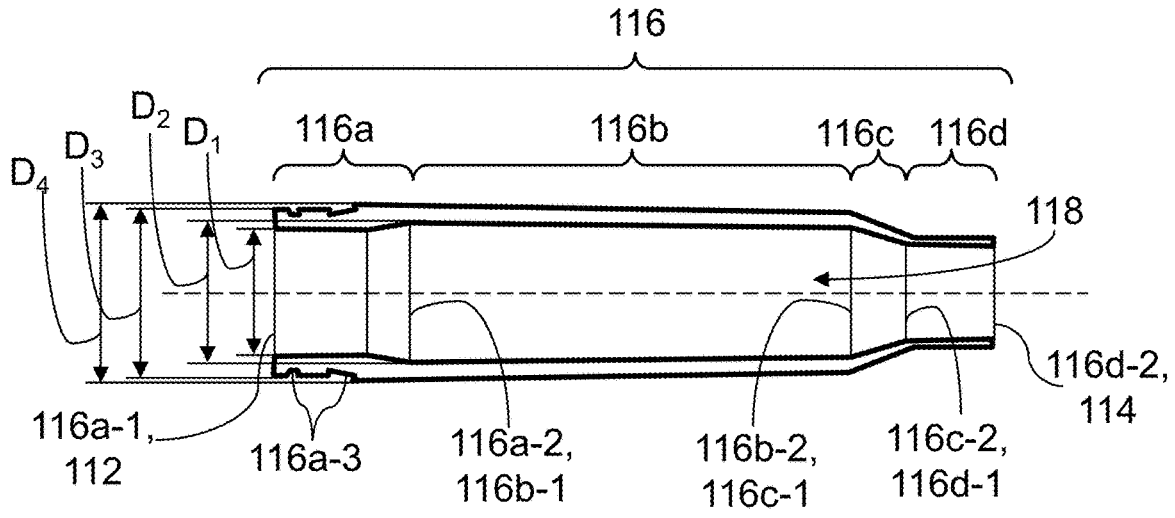

Reference is now made to FIGS. 1A-1 and FIG. 1A-2, which are schematic illustration of a polymeric casing body 100 having a thickened first longitudinal wall portion 116*a*, according to some embodiments of the invention. FIG. 1A schematically shows a longitudinal sectional view of casing body 100.

Figure 1B:
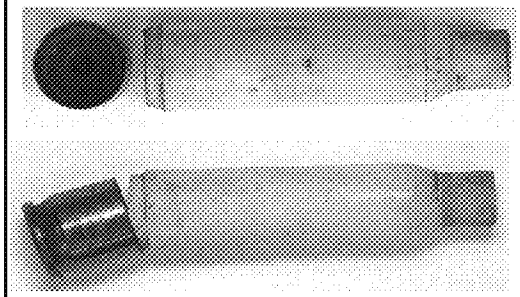
FIG. 1B shows a table with experimental results of firing tests and representative images of currently available polymer-based ammunition cartridge casings and the polymer-based ammunition cartridge casing having a thickened first longitudinal wall portion of the casing body according to some embodiments of the present invention.
Figure 1B:
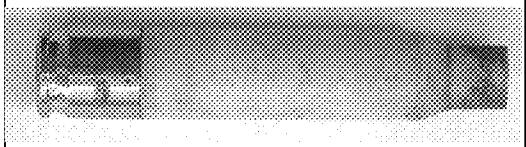

Reference is also made to FIG. 1B, which shows a table with experimental results of firing tests and representative images of currently available polymer-based ammunition cartridge casings and polymer-based ammunition cartridge casings having thickened first longitudinal wall portion 116*a* of casing body 100, after the firing tests, according to some embodiments of the present invention.

Casing body has a proximal end 112, a distal end 114, and a longitudinal cylindrical wall 116 extending between proximal end 112 and distal end 114 of casing body 100 and enveloping a hollow interior 118 of casing body 100. Hollow interior 118 of casing body 100 may accommodate a propellant.

Longitudinal cylindrical wall 116 of casing body 100 may include a first longitudinal wall portion 116*a* (e.g., a join wall portion). First longitudinal wall portion 116*a* may have a proximal end 116*a*-1 and a distal end 116*a*-2. Proximal end 116*a*-1 of first longitudinal wall portion 116*a* may coincide with or may include proximal end 112 of casing body 100. First longitudinal wall portion 116*a* is connectable to a casing base (not shown) having a primer.

In accordance with some embodiments of the present invention, the first longitudinal wall portion may be further shaped such that when the casing base is connected to it, at least most of the outer surface of the casing base remains exposed.

Longitudinal cylindrical wall 116 of casing body 100 may include a second longitudinal wall portion 116*b* (e.g., a body wall portion). Second longitudinal wall portion 116*b* may include a proximal end 116*b*-1 and a distal end 116*b*-2. Second longitudinal wall position 116*b* may be connected at its proximal end 116*b*-1 to distal end 116*a*-2 of first longitudinal wall portion 116*a*. In some embodiments, second longitudinal wall portion 116*b* may taper in a direction extending from its proximal end 116*b*-1 towards its distal end 116*b*-2.

As seen in FIG. 1A-1, casing body 100 may only include a first and a second longitudinal wall portions as detailed above. However, casing body 100 may include further longitudinal wall portions as seen in FIG. 1A-2.

In some embodiments, longitudinal cylindrical wall 116 of casing body 100 may include a third longitudinal wall portion 116*c* (e.g., a shoulder wall portion). Third longitudinal wall portion 116*c* may have a proximal end 116*c*-1 and a distal end 116*c*-2. Third longitudinal wall portion 116*c* may be connected at its proximal end 116*c*-1 to distal end 116*b*-2 of second longitudinal section 116*b*. Third longitudinal wall portion 116*c* may taper in a direction extending from its proximal end 116*c*-1 towards its distal end 116*c*-2.

In some embodiments longitudinal cylindrical wall 116 of casing body 100 may include a fourth longitudinal wall portion 116*d* (e.g., a neck wall portion). Fourth longitudinal wall portion 116*d* may have a proximal end 116*d*-1 and a distal end 116*d*-2. Fourth longitudinal wall portion 116*d* may be connected at its proximal end 116*d*-1 to distal end 116*c*-2 of third longitudinal section 116*c*. Distal end 116*d*-2 of fourth longitudinal wall portion 116*d* may coincide with or may include distal end 114 of casing body 100.

First longitudinal wall portion 116*a*, second longitudinal wall portion 116*b*, third longitudinal wall portion 116*c* and fourth longitudinal wall portion 116*d* may be formed as integral portions of longitudinal cylindrical wall 116 of casing body 100. In some embodiments, a minimal inner diameter of first longitudinal wall portion 116*a* (schematically indicated in FIG. 1A as "D1") may be smaller than an inner diameter of proximal end 116*b*-1 of second longitudinal wall portion 116*b* (schematical indicated in FIG. 1A as "D2"). This contrasts with the first longitudinal wall portion of currently available polymeric ammunition casing body in which the minimal inner diameter of the first longitudinal wall portion is the same (or substantially the same) as the inner diameter of the proximal end of the second longitudinal wall portion. Accordingly, first longitudinal wall portion 116*a* having the minimal inner diameter smaller than the inner diameter of proximal end 116*b*-1 of second longitudinal wall portion 116*b* may have a greater wall thickness and thus a greater mechanical strength as compared to the first longitudinal wall portion of currently available polymer-based ammunition cartridge casing.

Having first longitudinal wall portion 116*a* a greater mechanical strength compared with the first longitudinal wall portion of currently available polymer-based ammunition cartridge casings have several advantages. Additionally, it may cause first longitudinal wall portion 116*a* to withstand higher mechanical loads and specifically may guarantee that the base casing remains jointly connected to casing body 100 as a single casing assembly during a firing event. This contrasts with currently available polymer-based ammunition cartridge casings where the casing base tend to disengage from the casing body during a firing event.

The firing event may include feeding the cartridge into the firearm, striking of a firing pin of a firearm onto the primer, combustion of the propellant within hollow interior 118 of casing body 100, pressure build-up inside the barrel, bullet firing, extraction and ejection of the ammunition cartridge casing from the firearm, with the casing base still attached to casing body 100.

In some embodiments, a ratio of (i) the minimal inner diameter of first longitudinal wall portion 116*a* to (ii) the inner diameter of proximal end 116*b*-1 of second longitudinal wall portion 116*b* (e.g., referred hereinunder as "D1 to D2 ratios") is less than 0.97. In casing body 100 having the D1 to D2 ratio less than 0.97, a wall thickness of first longitudinal wall portion 116*a* in critical cross section (grooves) may be greater by at least 40% as compared to wall thickness of the first longitudinal wall portion of currently available polymer-based ammunition casings having the D1 to D2 ratio of 1. Accordingly, in casing body 100 having the D1 to D2 ratio less than 0.97, first longitudinal wall portion 116*a* may have greater mechanical strength than the first longitudinal wall portion of currently available polymer-based ammunition casings. Therefore, in casing body 100 having the D1 to D2 ratio less than 0.97, first longitudinal wall portion 116*a* may withstand greater mechanical loads during the firing event as compared to the first longitudinal wall portion of currently available polymer-based ammunition casings. For example, as shown in the Table in FIG. 1B, 20% of polymer-based ammunition casings having D1 to D2 ratio greater than 0.97 exhibited unintended mechanical failures during firing tests, while none of casing bodies 100 having D1 to D2 ratio less than 0.97 according to some embodiments of the present invention exhibited the unintended mechanical failures during firing tests.

In some embodiments, the first and the second longitudinal wall portions form a monolithic common element. In other embodiments first, second and the third longitudinal wall portions form a monolithic common element. In other words, the entire polymeric casing body is formed of a single element.

Advantageously, having a monolithic polymeric casing results in a more robust polymeric casing which is less prone to unintended mechanical failures during firing compared with polymeric casing made with two or more parts. Manufacturing a monolithic polymeric casing body also results in a cheaper manufacturing process compared with multi-part polymeric casing body.

In some embodiments, the ratio of (i) the minimal inner diameter of first longitudinal wall portion 116*a* to (ii) the inner diameter of proximal end 116*b*-1 of second longitudinal wall portion 116*b* (e.g., the D1 to D2 ratio) is greater than 0.90. Casing body 100 having the D1 to D2 ratio greater than 0.90 may be manufactured in a molding process. Specifically, first longitudinal wall portion 116*a* of casing body 100 having the D1 to D2 ratio greater than 0.90 can be released from typical molds upon curing of the polymeric/composite material within the molds and can be released without significantly deforming the dimensions of the casing body 100.

Currently, it is challenging to manufacture a first longitudinal wall portion 116*a* of casing body 100 having a D1 to D2 ratio less than 0.90 because it may either cause a significant deformation of the casing body 100, or casing body 100 sticking within the mold, which may require utilization of different manufacturing processes.

In some embodiments, the ratio of (i) the minimal inner diameter of first longitudinal wall portion 116*a* to (ii) the inner diameter of proximal end 116*b*-1 of second longitudinal wall portion 116*b* (e.g., the D1 to D2 ratio) ranges between 0.90 and 0.97.

In some embodiments, an outer diameter of first longitudinal wall portion 116*a* (schematically indicated in FIG. 1A as "D3") may be less than an outer diameter of the second longitudinal wall portion (schematically indicated in FIG. 1A as "D4").

In some embodiments, first longitudinal wall portion 116*a* may include one or more external circumferential grooves 116*a*-3 on an outer surface of first longitudinal wall portion 116*a*. One or more external circumferential grooves 116*a*-3 on the outer surface of first longitudinal wall portion 116*a* may mate with one or more internal circumferential protrusions on an inner surface of the casing base (not shown) to connect the casing base to first longitudinal wall portion 116*a* of casing body 100. For example, one or more external circumferential grooves 116*a*-3 may be formed as a thread on the outer surface of first longitudinal wall portion 116*a* or any other connection means known in the art. Embodiments of the invention may increase the mechanical strength of sections that are prone to a high rate of failure during firing events (e.g., at the interface of the threading). This may be because, according to embodiments of the invention, such sections are thicker, comprising more polymeric material than currently available polymer-based ammunition cartridge casings.

Figure 2A:
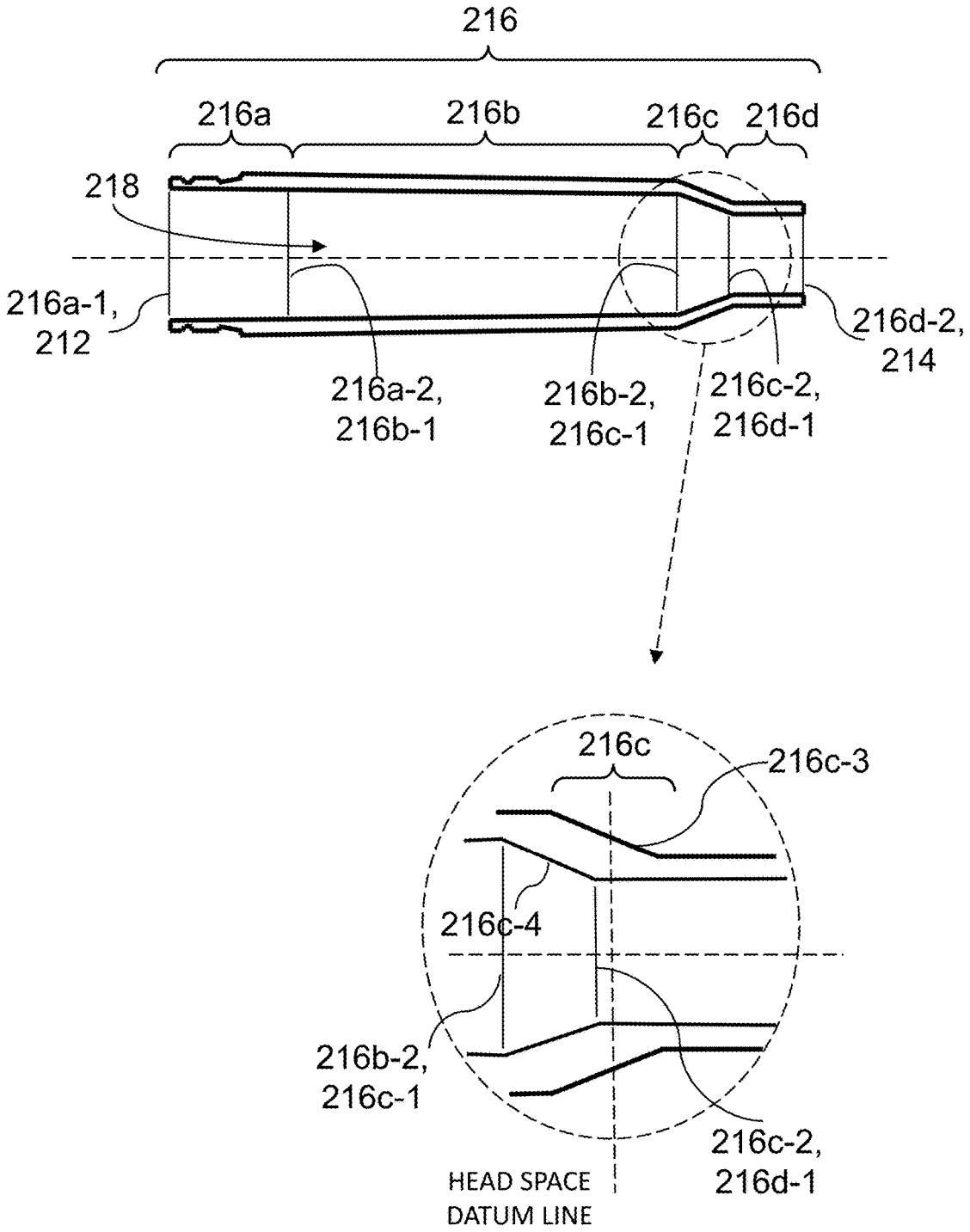
FIG. 2A is schematic illustration of a polymeric casing body having a third longitudinal wall portion with inner and outer surfaces, an end of the inner surface not extending beyond the head space datum line when measured from the direction of proximal end, according to some embodiments of the invention.

Reference is now made to FIG. 2A which is a schematic illustration of a casing body 200 having a third longitudinal wall portion 216*c* with inner and outer surfaces, according to some embodiments of the invention. The inner surface may have any shape, for example, planar, convex, or concave. FIG. 2A schematically shows a longitudinal sectional view of casing body 200 and further shows an enlarged partial longitudinal sectional view of third longitudinal wall portion 216*c*.

Casing body 200 has a proximal end 212, a distal end 214 and a longitudinal cylindrical wall 216 extending between proximal end 212 and distal end 214 of casing body 200 and enveloping a hollow interior 218 of casing body 200.

Hollow interior 218 of casing body 200 may accommodate a propellant. Longitudinal cylindrical wall 216 of casing body 200 may include: (i) a first longitudinal wall portion 216*a* having a proximal end 216*a*-1 coinciding with proximal end 212 of casing body 200 and configured to connect a casing base with a primer (not shown); (ii) a second longitudinal wall portion 216*b* connected at its proximal end 216*b*-1 to a distal end 216*a*-2 of first longitudinal wall portion 216; (iii) a third longitudinal wall portion 216*c* connected at its proximal end 216*c*-1 to a distal end 216*b*-2 of second longitudinal section 216*b* and tapering in a direction extending from its proximal end 216*c*-1 towards its distal end 216*c*-2; and (iv) a fourth longitudinal wall portion 216*d* connected at its proximal end 216*d*-1 to the distal end 216*c*-2 of third longitudinal section 216*c* and having a distal end 216*d*-2 coinciding with distal end 216*d*-2 of casing body 200. First longitudinal wall portion 216*a*, second longitudinal wall portion 216*b*, third longitudinal wall portion 216*c* and fourth longitudinal wall portion 216*d* may be formed as integral portions of longitudinal cylindrical wall 216 of casing body 200.

In some embodiments, an end of inner surface 216*c*-4 (i.e., 216*c*-2) (having any shape, such as planar, concave, or convex) of third longitudinal wall portion 216*c* may not extend beyond the headspace datum line of the ammunition cartridge casing, which is defined in international standards, i.e., may not extends, at least partially, beyond the headspace datum line along a circumference of the inner surface, wherein a location of the headspace datum line is established by a standard for each type of ammunition cartridge.

In some other embodiments, the distal end of inner surface 216*c*-4 (i.e., 216*c*-2) (having any shape, such as planar, concave, or convex) of third longitudinal wall portion 216*c* may not extend beyond the distal end of outer surface 216*c*-3 of third longitudinal wall portion 216*c*.

According to some embodiments of the present invention, an end of inner surface 216*c*-4 of third longitudinal wall portion 216*c* may not exceed the head space datum line, alternately along its inner circumference, when measured from the direction of the proximal end.

This contrasts with the third longitudinal wall portion of currently available polymer-based ammunition casings in which the inner surface of the third longitudinal wall portion does extend beyond the datum line when measured from the direction of proximal end 212. Accordingly, third longitudinal wall portion 216*c* having an inner surface 216*c*-4 which does not exceed the datum line (when measured from the direction of proximal end 212) may result in a casing body in which—in an embodiment which includes a third and a fourth regions—the transition area between the third and fourth inner regions 216*c*-2 and 216*d*-1 is less than or equal to the head space of the ammunition article (according to international standards—e.g. SAAMI, CIP, STANAG etc.) measured from the direction of the base of the ammunition article.

According to another embodiment of the present invention, the polymer-based ammunition cartridge casing may include a casing body having a proximal end, a distal end and a longitudinal cylindrical wall extending between the proximal end and the distal end and enveloping a hollow interior of the casing body, wherein the longitudinal cylindrical wall of the casing body may include: a first longitudinal wall portion comprising the proximal end of the casing body and shaped to connect a to a casing base; a second longitudinal wall portion connected at its proximal end to a distal end of the first longitudinal wall portion; a third longitudinal wall portion connected at its proximal end to a distal end of the second longitudinal section and tapering in a direction extending from the proximal end towards a distal end of the third longitudinal section, wherein an inner surface of the third longitudinal wall portion is any shape having an end which at least partially, does not extend beyond the head space datum line when measured from the direction of the casing base.

According to this embodiments, the inner surface of the third longitudinal wall portion having an end which, does not extend beyond the head space datum line, alternately along its inner circumference, when measured from the direction of the casing base.

The aforementioned improved geometry give rise to the following advantages:

1) Guaranteeing a proper initiation of the ammunition cartridge/a proper ignition of the primer: in order to prevent mechanical failures and cracks along the casing during firing which involves super-fast dynamics. When producing polymeric based ammunition articles, impact modified polymers are usually being used. This type of materials tends to cause failures such as misfiring of the primer. This failure is caused because the impact modified polymer of the casing body tends to absorb the impact applied by the filing pin onto the primer. The aforementioned improved geometry leads to strengthening the structure of the casing body and eliminates the misfiring problem;
2) Increasing the structural strength of the ammunition cartridge due to a change of the stress distribution in the third longitudinal section 216 of the casing body 200 during firing; and
3) Increasing the transport and support of the projectile within the ammunition cartridge casing and enables an integration of sealing means between the projectile and the ammunition cartridge casing. For example, a combination of an O-ring and a sealing material.

As will be known to one skilled in the art, the term headspace is the measurement from the casing base to a datum line on the casing, usually specified as a point on the shoulder at which the casing is of a certain diameter (which is specified by the cartridge designer and defined in known standards for ammunition). Accordingly, for a given type of ammunition (e.g., 5.56 mm) the head space datum line will be a well-defined reference measurement. The datum line indicates the location where the ammunition cartridge longitudinally rests against the chamber.

Figure 3:
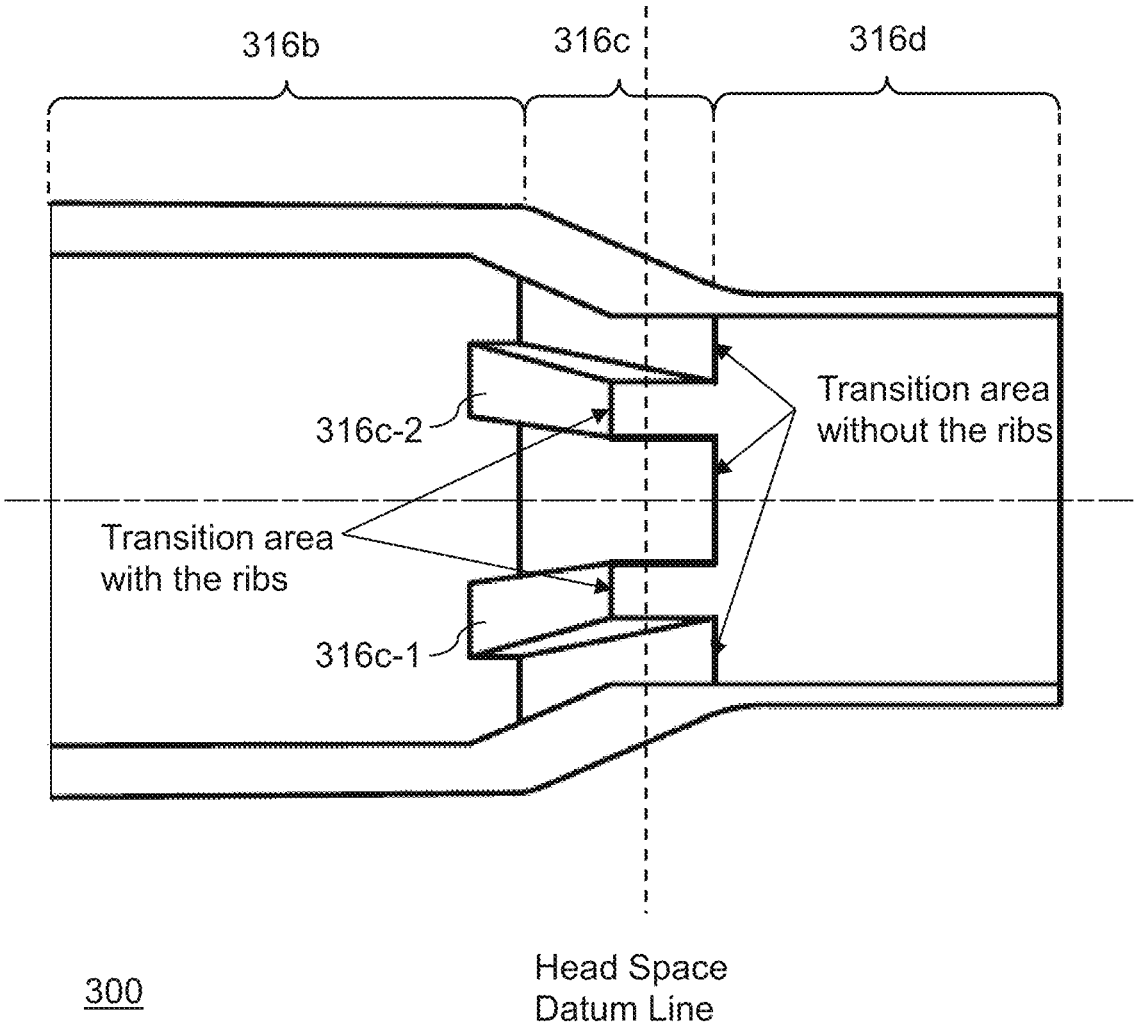
FIG. 3 is a schematic illustration of a casing body having a third longitudinal wall portion with reinforcement ribs on an inner surface thereof, such that in the location of reinforcement ribs, the transition between the third and fourth portions does not extend beyond the head space datum line when measured from the direction of proximal end, according to some embodiments of the invention.

Reference is now made to FIG. 3 which is a partial longitudinal cross-section of polymeric casing body 300 showing the inner surface of third longitudinal wall portion 316*c* and the transition areas thereof with second longitudinal wall portion 316*b* and fourth longitudinal wall portion 316*d*.

According to some embodiments of the present invention, the inner surface of third longitudinal wall portion 316*c* may include a plurality of reinforcement ribs 316*c*-1 and 316*c*-2 protruding into hollow interior of casing body 300.

According to some embodiments of the present invention the geometry of reinforcement ribs (e.g., 316*c*-1 and 316*c*-2) is designed such that, where the reinforcement ribs are positioned, the inner transition area between third longitudinal wall portion 316*c* and fourth longitudinal wall portion 316*d* or end of inner surface of third longitudinal wall portion does not exceed the head space datum line, when measured form the direction of the proximal end. In some embodiments, reinforcement ribs may protrude from inner surface of third longitudinal wall portion 316*c* into hollow interior 318 of casing body 300.

In some embodiments, 4-8 of reinforcement ribs (e.g., 316*c*-1 and 316*c*-2) are used. In some embodiments, reinforcement ribs (e.g., 316*c*-1 and 316*c*-2) may be evenly spaced along a circumference of the inner surface of third longitudinal wall portion.

The aforementioned structure is advantageous since it allows some of the inner transition area between the third and the fourth sections (e.g., between the shoulder and the neck) to occur before the head space datum line and some of the transition area to occur after the head space datum line. This may further maximize the inner volume of the casing body and thus reduce the maximal pressure value developed in the firearm chamber due to combustion of the propellent, or alternatively, allowing providing more propellant within the casing body.

Figure 4A:
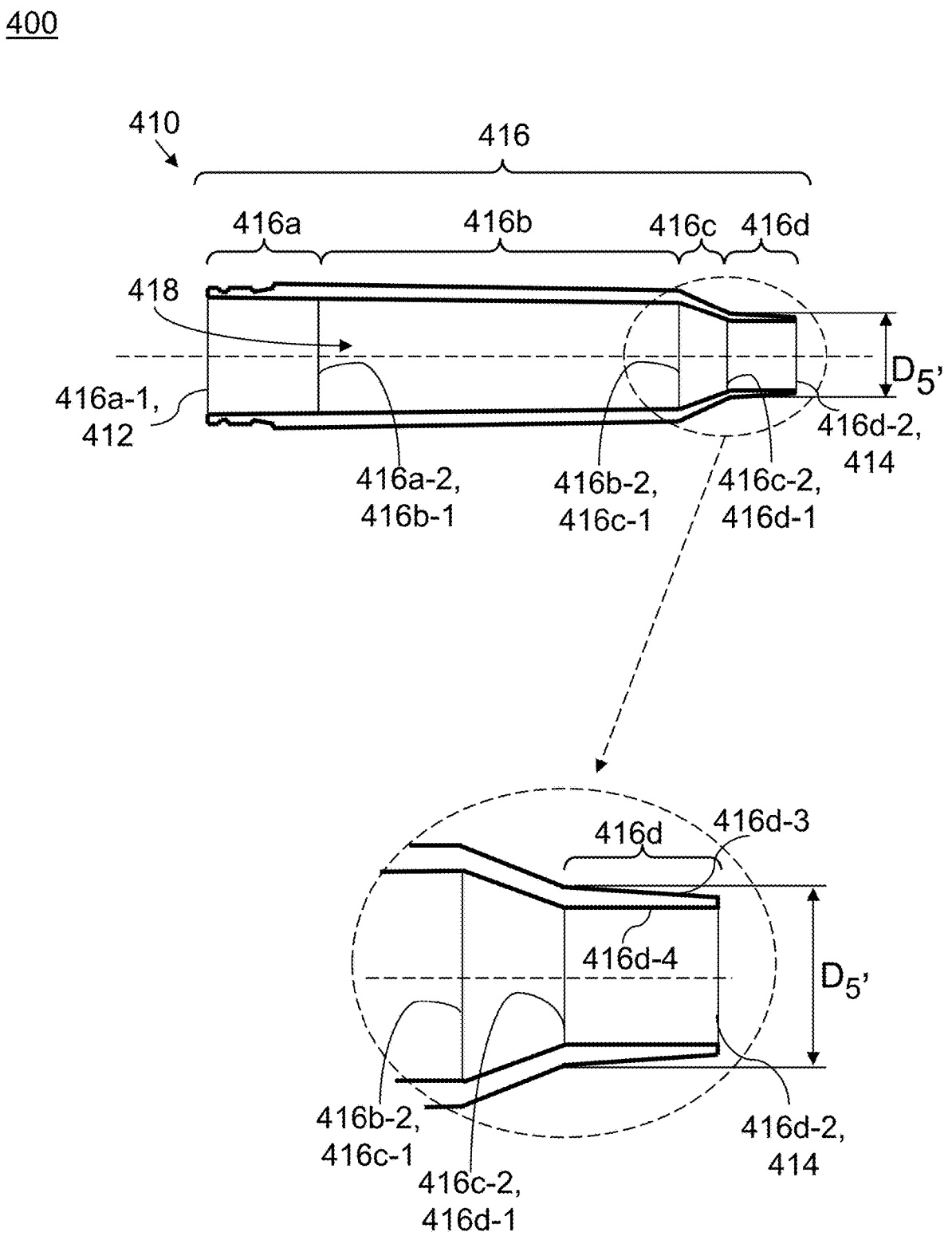
FIG. 4A is schematic illustration of a polymeric casing body having fourth longitudinal wall portion with non-parallel outer and inner surfaces thereof, according to some embodiments of the invention.

Reference is now made to FIG. 4A, which is a schematic illustration of a polymeric or composite casing body 400 having fourth longitudinal wall portion 416*d* with non-parallel outer and inner surfaces 416*d*-3, 416*d*-4 thereof, according to some embodiments of the invention. FIG. 4A schematically shows a longitudinal sectional view of polymeric casing body 400 and further shows an enlarged partial longitudinal sectional view of fourth longitudinal wall portion 416*d*.

Polymeric casing body 400 has a proximal end 412, a distal end 414 and a longitudinal cylindrical wall 416 extending between proximal end 412 and distal end 414 of casing body 400 and enveloping a hollow interior 418 of casing body 400. Hollow interior 418 of casing body 400 may accommodate a propellant. Longitudinal cylindrical wall 416 of casing body 400 may include: (i) a first longitudinal wall portion 416*a* having a proximal end 416*a*-1 coinciding with proximal end 412 of casing body 400 and configured to connect a case base having a primer of an ammunition article; (ii) a second longitudinal wall portion 416*b* connected at its proximal end 416*b*-1 to a distal end 416*a*-2 of first longitudinal wall portion 416; (iii) a third longitudinal wall portion 416*c* connected at its proximal end 416*c*-1 to a distal end 416*b*-2 of second longitudinal section 416*b* and tapering in a direction extending from its proximal end 416*c*-1 towards its distal end 416*c*-2; and (iv) a fourth longitudinal wall portion 416*d* connected at its proximal end 416*d*-1 to the distal end 416*c*-2 of third longitudinal section 416*c* and having a distal end 416*d*-2 coinciding with distal end 416*d*-2 of casing body 400. First longitudinal wall portion 416*a*, second longitudinal wall portion 416*b*, third longitudinal wall portion 416*c* and fourth longitudinal wall portion 416*d* may be formed as integral portions of longitudinal cylindrical wall 416 of casing body 400.

In some embodiments, an outer surface 416*d*-3 and an inner surface 416*d*-4 of fourth longitudinal wall portion 416*d* may be non-parallel with respect to each other along their entire lengths (e.g., as shown in FIG. 4A). In some embodiments, outer surface 416*d*-3 of fourth longitudinal wall portion 416*d* may taper, along its entire length, in a longitudinal direction extending from proximal end 416*d*-1 towards distal end 416*d*-2 of fourth longitudinal wall portion 416*d* (e.g., as shown in FIG. 4A). For example, a slope of outer surface 416*d*-3 of fourth longitudinal wall portion 416*d* in the longitudinal direction may range between 0.2-5°. In some embodiments, inner surface 416*d*-4 of fourth longitudinal wall portion 416*d* may taper, along its entire length, in the longitudinal direction extending from distal end 416*d*-2 towards proximal end 416*d*-1 of fourth longitudinal wall portion 416*d*.

This contrasts with currently available polymer-based ammunition cartridge casing in which the outer surface and the inner surface of the fourth longitudinal wall portion are parallel (or substantially parallel) to each other.

It should be noted that D5 is defined as outer diameter of proximal end 416*d*-1 of fourth longitudinal wall portion 416*d* when the projectile is assembled, so the aforementioned diameter without the projectile assembled is denoted as D5'. The maximal allowable standard value for D5 may be a value defined by known standards. For example, the known standards may include civil or military standards. The known standards may, for example, include SAAMI, C.I.P., STANAG (NATO), U.S. DoD standards.

In some embodiments, D5' may designed such that a corresponding D5 may be greater than a maximal allowable standard value thereof. For example, D5 may be greater by up to 0.8% as compared to the maximal allowable standard value thereof.

Fourth longitudinal wall portion 416*d* having tapered outer/inner surfaces and the outer diameter of its proximal end 416*d*-1 greater than the maximal allowable value thereof for an assembled cartridge according to known standards may have a greater wall thickness and thus a greater mechanical strength as compared to the fourth longitudinal wall portion of currently available polymer-based ammunition cartridge casing. Fourth longitudinal wall portion 416*d* having greater mechanical strength as compared to the fourth longitudinal wall portion of a currently available polymer-based ammunition cartridge casing may, for example, cause fourth longitudinal wall portion 416*d* to withstand higher mechanical loads during the firing event as compared to the fourth longitudinal portion of currently available polymer-based ammunition cartridge casing.

According to some embodiments of the invention, a polymer-based ammunition cartridge casing may include polymeric/composite casing bodies 100, 200, 300, and 400 described hereinabove, having outer transverse dimensions greater than maximal allowable standard in an assembled cartridge configuration of values thereof. The maximal allowable standard value may be a value defined by known standards. For example, the known standards may include civil or military standards. The known standards may, for example, include SAAMI, C.I.P., STANAG (NATO), U.S. DoD standards.

According to yet another embodiment of the present invention, the polymer-based ammunition cartridge casing may include: a casing body having a proximal end, a distal end and a longitudinal cylindrical wall extending between the proximal end and the distal end and enveloping a hollow interior of the casing body, wherein at least one of the longitudinal wall portions have outer transverse dimensions greater than maximal allowable standard values thereof. According to this embodiment, the longitudinal cylindrical wall of the casing body may include: a first longitudinal wall portion comprising the proximal end of the casing body and shaped to connect a to a casing base; a second longitudinal wall portion connected at its proximal end to a distal end of the first longitudinal wall portion; a third longitudinal wall portion connected at its proximal end to a distal end of the second longitudinal section and tapering in a direction extending from the proximal end towards a distal end of the third longitudinal section; and a fourth longitudinal wall portion connected at its proximal end to the distal end of the third longitudinal section and comprising the distal end of the casing body, wherein at least one of: the first, the second, the third, and the fourth longitudinal wall portions have outer transverse dimensions greater than maximal allowable standard values thereof.

The maximal allowable standard values are typically predefined for ammunition articles having metal ammunition cartridge casings. As such, the maximal allowable standard values for the outer transverse dimensions thereof are predefined such that a gap is formed between the metal ammunition cartridge casing and a firearm chamber to allow a metal ammunition cartridge casing to be loaded into the firearm chamber. In contrast, radial expansion of the polymeric/composite casing body as a result of the pressure build-up within the interior of the polymeric casing body may cause a mechanical failure of the polymer-based ammunition cartridge casing. In order to prevent mechanical failure of the polymer-based ammunition casing due to expansion thereof during the firing event, the gap between the polymeric/composite casing body and the firearm chamber when the polymeric/composite casing body is loaded into the firearm chamber needs to be reduced as compared to when a metal ammunition cartridge casing is used. The reduction of the gap may be achieved by, for example, providing the polymeric casing body with outer transverse dimensions greater than the maximal allowable standard values thereof.

For example, the second longitudinal wall portion of the casing body of the polymer-based ammunition cartridge casing may have an outer diameter greater than a maximal allowable standard value thereof. For example, the second longitudinal wall portion of the casing body of the polymer-based ammunition cartridge casing may have an outer diameter that is greater by up to 0.3% as compared to the maximal allowable standard value thereof.

According to some embodiments of the invention, an ammunition cartridge casing may include a polymeric or composite casing body (e.g., such as polymeric or composite casing body 100, 200, 300, and 400 described hereinabove) which includes a polymeric or composite material having a Vicat softening temperature (rate B/120) of at least 120° C. according to ISO306 (50N, 120° C./h).

According to some embodiments of the invention, an ammunition cartridge casing may include a polymeric or composite casing body (e.g., such as polymeric or composite casing body 100, 200, 300, and 400 described hereinabove) which includes a polymeric or composite material having a heat deflection temperature of at least 90° C. according to ISO 75 (1.8 Mpa).

According to some embodiments of the invention, an ammunition cartridge casing may include a polymeric or composite casing body (e.g., such as polymeric or composite casing body 100, 200, 300, and 400 described hereinabove) which includes a polymeric or composite material having a Vicat softening temperature (rate B/120) of at least 120° C. in accordance with ISO306 (50N, 120° C./h) and heat deflection temperature of at least 90° in accordance with ISO75 (1.8 MPa).

Figure 5:
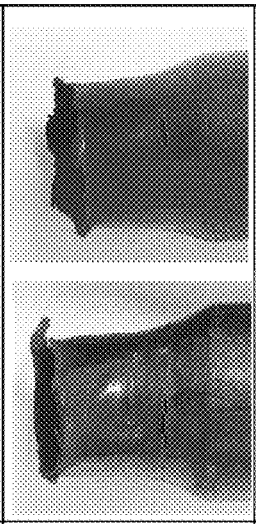
FIG. 5 shows a table with experimental results of firing tests and representative images of currently available polymer-based or composite ammunition cartridge casing and the polymer-based or composite ammunition cartridge casing having Vicat softening temperature (rate B/120) (VST) greater than 120° C. in accordance with ISO306 (50N, 120° C./h) and heat deflection temperature greater than 90° in accordance with ISO75 (1.8 MPa) after the firing tests, according to some embodiments of the present invention.
Figure 5:
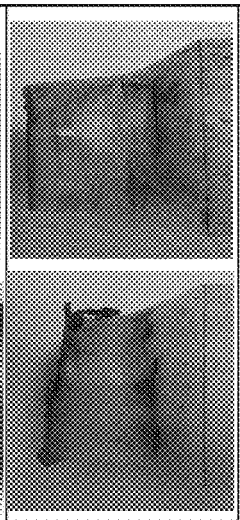
Figure 5:
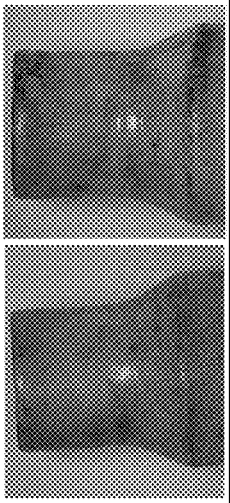
Figure 5:
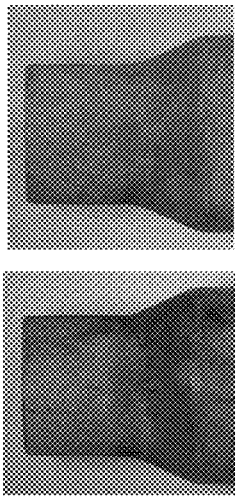

Reference is now made to FIG. 5, which shows a table with experimental results of firing tests and representative images of polymer-based ammunition cartridge casing having a polymeric or composite casing body with a Vicat softening temperature (rate B/120) greater than 120° C. in accordance with ISO306 (50N, 120° C./h) and heat deflection temperature greater than 90° in accordance with ISO75 (1.8 MPa) after the firing tests, according to some embodiments of the present invention.

As shown in FIG. 5, ammunition casing body including polymeric or composite material having Vicat softening temperature (rate B/120) less than 120° C. and heat deflection temperature less than 90° exhibited unintended mechanical failures during firing tests, while polymeric or composite casing body having Vicat softening temperature (rate B/120) greater than 120° C. in accordance with ISO306 (50N, 120° C./h) and heat deflection temperature greater than 90° in accordance with ISO75 (1.8 MPa) exhibited no unintended mechanical failures during firing tests.

Advantageously, polymer-based ammunition cartridge casings according to some embodiments of the present invention may include polymeric/composite casing bodies 100, 200, 300, and 400 described hereinabove, may have a greater mechanical strength without reducing (or substantially without reducing) a volume of an interior of the polymeric/composite ammunition cartridge casings as compared to currently available polymer-based ammunition cartridge casings.

According to some embodiments of the present invention, in the transition areas between the cylindrical wall portions of the casing body various additional structural features may be applied, for example, a radius or a chamfer, as a part of design or technological considerations.

It should be noted that in the above description the proximal and the distal ends of the wall portions are referred to as meeting/intersection point (or theoretical intersection point) of the various wall portions. For example, the end of the third inner surface is intersection/theoretical intersection between third and fourth inner wall sections.

Figure 6:
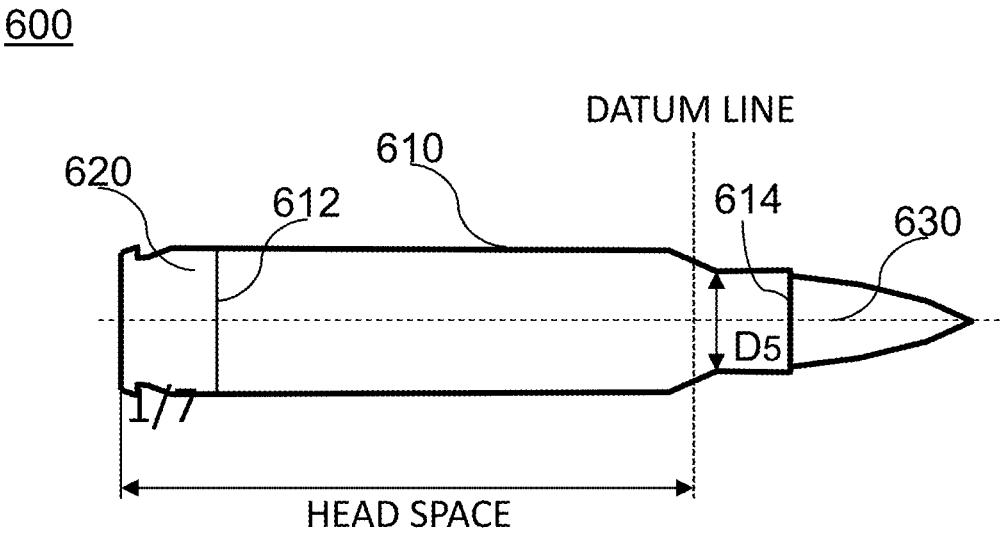
FIG. 6 which is a schematic illustration of an ammunition article having a polymeric casing body and a casing base made from a different material, according to some embodiments of the invention.

Reference is now made to FIG. 6, which is a schematic illustration of an ammunition article 600. According to some embodiments of the invention, ammunition article 600 may include a polymeric casing body 610, a casing base 620 connectable to a proximal end 612 of polymeric casing body 610, and a projectile 630 connectable to a distal end 614 of polymeric casing body 610. Polymeric casing body 610 may be any of polymeric/composite casing bodies 100, 200, 300, and 400 described hereinabove. FIG. 6 also illustrates the headspace and datum line definitions which are known in the art. Diameter D5 discussed above is also indicated here per the standard definition which relate to an assembled ammunition cartridge.

In the above description, an embodiment is an example or implementation of the invention. The various appearances of "one embodiment", "an embodiment", "certain embodiments" or "some embodiments" do not necessarily all refer to the same embodiments. Although various features of the invention can be described in the context of a single embodiment, the features can also be provided separately or in any suitable combination.

Conversely, although the invention can be described herein in the context of separate embodiments for clarity, the invention can also be implemented in a single embodiment. Certain embodiments of the invention can include features from different embodiments disclosed above, and certain embodiments can incorporate elements from other embodiments disclosed above. The disclosure of elements of the invention in the context of a specific embodiment is not to be taken as limiting their use in the specific embodiment alone. Furthermore, it is to be understood that the invention can be carried out or practiced in various ways and that the invention can be implemented in certain embodiments other than the ones outlined in the description above.

The invention is not limited to those diagrams or to the corresponding descriptions. Meanings of technical and scientific terms used herein are to be commonly understood as by one of ordinary skill in the art to which the invention belongs, unless otherwise defined. While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A polymer-based ammunition cartridge casing comprising:

a casing body having a proximal end, a distal end and a longitudinal cylindrical wall extending between the proximal end and the distal end and enveloping a hollow interior of the casing body, wherein the longitudinal cylindrical wall of the casing body comprises:

a first longitudinal wall portion which coincides with the proximal end of the casing body and is shaped to connect to a casing base, and further shaped such that when the casing base is connected, at least most of an outer surface of the casing base remains exposed;

a second longitudinal wall portion connected at its proximal end to a distal end of the first longitudinal wall portion, wherein a minimal inner diameter of the first longitudinal wall portion is smaller than an inner diameter of the proximal end of the second longitudinal wall portion, and wherein the outer diameter of the first longitudinal wall portion is smaller than an outer diameter of the second longitudinal wall portion, wherein the ratio of (i) the minimal inner diameter of first longitudinal wall portion to (ii) the inner diameter of proximal end of the second longitudinal wall portion ranges between 0.90 and 0.97.

2. The polymer-based ammunition cartridge casing of claim 1, comprising one or more circumferential grooves on an outer surface of the first longitudinal wall portion, the one or more circumferential grooves configured to connect the casing base to the first longitudinal wall portion.

3. The polymer-based ammunition cartridge casing of claim 1, further comprising:

a casing body having a proximal end, a distal end and a longitudinal cylindrical wall extending between the proximal end and the distal end and enveloping a hollow interior of the casing body, wherein at least one of the longitudinal wall portions have outer transverse dimensions greater than maximal allowable standard values thereof.

4. The polymer-based ammunition cartridge casing of claim 1, wherein the longitudinal cylindrical wall of the casing body comprises:

a first longitudinal wall portion comprising the proximal end of the casing body and shaped to connect a to a casing base;

a second longitudinal wall portion connected at its proximal end to a distal end of the first longitudinal wall portion;

a third longitudinal wall portion connected at its proximal end to a distal end of the second longitudinal section and tapering in a direction extending from the proximal end towards a distal end of the third longitudinal section; and a fourth longitudinal wall portion connected at its proximal end to the distal end of the third longitudinal section and comprising the distal end of the casing body, wherein at least one of: the first, the second, the third, and the fourth longitudinal wall portions have outer transverse dimensions greater than maximal allowable standard values thereof.

5. The polymer-based ammunition cartridge casing of claim 4, wherein an outer surface and an inner surface of the fourth longitudinal wall portion are non-parallel with respect to each other, and wherein an outer surface of the fourth longitudinal wall portion tapers in a direction extending from the proximal end towards the distal end of the fourth longitudinal wall portion.

6. The polymer-based ammunition cartridge casing of claim 4, wherein an outer surface and an inner surface of the fourth longitudinal wall portion are non-parallel with respect to each other, and wherein an inner surface of the fourth longitudinal wall portion tapers in a direction extending from the distal end towards the proximal end of the fourth longitudinal wall portion.

7. The polymer-based ammunition cartridge casing of claim 1, wherein the casing body comprises a polymeric or composite material having a Vicat Softening Temperature of at least 120° C. and a Heat Deflection Temperature of at least 90° C.

* * * * *